US006033599A

United States Patent [19]

Lozano et al.

[11] Patent Number: 6,033,599

[45] Date of Patent: Mar. 7, 2000

[54] VAPOR PHASE CORROSION INHIBITORS

[75] Inventors: Eduardo Lozano, Abbotsford; John Anthony Shipley, Mission, both of Canada

[73] Assignee: Interwrap Industries Inc., Mission, Canada

[21] Appl. No.: 09/170,050

[22] Filed: Oct. 13, 1998

[51] Int. Cl.[7] ..... C23F 11/02; C23F 11/18

[52] U.S. Cl. ..... 252/389.54; 252/389.61; 252/389.62; 428/35.7; 428/35.8; 428/457; 428/461

[58] Field of Search ..... 252/389.61, 389.62, 252/389.54

[56] References Cited

U.S. PATENT DOCUMENTS

| | | | |
|---|---|---|---|
| 5,139,700 | 8/1992 | Miksic et al. | 252/389.54 |
| 5,320,778 | 6/1994 | Miksic et al. | 252/389.54 |
| 5,344,589 | 9/1994 | Miksic et al. | 252/392 |
| 5,422,187 | 6/1995 | Miksic et al. | 428/545 |
| 5,715,945 | 2/1998 | Chandler | 206/524.4 |
| 5,855,975 | 1/1999 | Miksic et al. | 428/35.8 |

*Primary Examiner*—Ellen M. McAvoy
*Attorney, Agent, or Firm*—Pillsbury Madison & Sutro LLP

[57] ABSTRACT

A corrosion inhibiting composition includes, by weight, 2% to 20% alkali metal nitrite or alkaline earth metal nitrite, 16% to 90% alkali metal benzoate or alkaline earth metal benzoate and 4% to 50% alkali metal molybdate or alkaline earth metal molybdate. The composition is mixed with a resin carrier to form a master batch. A plastic composition containing a corrosion inhibiting component and a resin is also provided wherein the corrosion inhibiting component includes 0.13% to 1.25% alkali metal nitrite or alkaline earth metal nitrite, 1% to 5.63% alkali metal benzoate or alkaline earth metal benzoate and 0.25% to 3.13% alkali metal molybdate or alkaline earth metal molybdate by weight of the plastic composition. The plastic composition can be formed into a film which can be used to cover metal articles thereby preventing corrosion.

11 Claims, No Drawings

VAPOR PHASE CORROSION INHIBITORS

BACKGROUND OF THE INVENTION

1. Field of the Invention

The present application relates to products for inhibiting the corrosion of metal articles. More specifically, the present application relates to a vapour phase corrosion inhibitor which can be incorporated into plastic packaging materials.

2. Discussion of Related Art

Corrosion of metal articles has been the subject of a great deal of study. The most widely known form of corrosion is rust which occurs when iron and metals containing iron are exposed to moisture and oxygen in the air. Corrosion is a significant problem during the storage, handling and transportation of corrodible metal articles as it is difficult and impractical to remove oxygen from the atmosphere in which metal articles are packaged.

One of the first techniques for overcoming the problem of corrosion was to coat all the exposed surfaces of corrodible metal articles with a non-corrodible coating such as paint, varnish, grease or the like. This technique is, however, expensive and time consuming.

A more useful and successful system of preventing the corrosion of metal articles is to package the articles with a material containing a vapour phase corrosion inhibitor. Functioning by slowly releasing vapours that contact the surface of the metals, the vapour phase corrosion inhibitors serve to envelope the metal article in a non-corrosive atmosphere and retard the moisture and oxygen present in the atmosphere from attacking the metal surfaces.

Vapour phase corrosion inhibitors may be applied by spraying the entire surface of the metal article to be protected or the metal article itself may be enclosed, packaged or surrounded in or with materials containing volatile corrosion inhibitors.

U.S. Pat. No. 3,443,577 to Shick discloses a method of protecting metal articles from atmospheric corrosion in which the articles are packaged in a material which has been treated with a vapour phase corrosion inhibitor composition consisting essentially of sodium nitrite and sodium phosphate.

U.S. Pat. No. 4,416,701 to Conner discloses a metal corrosion inhibitor which is prepared by adding an alkali metal nitrite, ammonium benzoate, an alkylalkanolamine and a nitrogenous base such as urea, to water. The inhibitor may be applied as a mist of spray to the exposed edges of coiled sheet steel to protect the steel during storage or may be fogged into a shipping container to protect the steel during shipping.

Other vapour phase corrosion inhibitors are disclosed in U.S. Pat. Nos. 4,338,209, 4,349,457, 4,402,747, 4,557,966, 4,963,290, 4,973,448 and 5,303,743.

U.S. Pat. Nos. 5,209,869, 5,320,778, 5,344,589 and 5,422,187, all issued to Miksic, disclose vapour corrosion inhibitor/desiccant formulations. The inhibitors described in these four related patents are selected from formulations comprising anhydrous molybdates mixed with benzotriazole and sodium nitrite or from a formulation comprising amine benzoate, amine nitrates and benzotriazole. These patents disclose that the formulations can be incorporated into permeable capsules or into laminates containing a central metal layer.

There are a number of issues that require addressing when trying to make a vapour corrosion inhibitor that can be incorporated into plastic wrapping materials. Firstly, the right compounds must be identified and then combined in the correct ratios and levels in the plastic in order to give optimal corrosion inhibition. The second issue is to find an inhibitor that is sufficiently volatile to act in the vapour phase at room temperature (approximately 20° C.) but that will not be significantly volatilized under the high temperatures (in excess of 300° C.) normally encountered during processing of plastics. Furthermore, it is important that none of the components decompose under this high temperature.

The third issue to be addressed in preparing a suitable vapour corrosion inhibitor formulation is the question of toxicity. Many of the inhibitor compositions disclosed in the patents described above contain chromates, amines and nitrites. Although these types of compounds are effective corrosion inhibitors, it is known that chromates and combinations including amines and nitrites are deleterious to health.

The final issue is to find a formulation that is economical to produce. A formulation that acts as an effective corrosion inhibitor, is still effective after high temperature processing and is non-toxic may still not be practical if it is too expensive to be used at the required levels.

There is, therefore, a need to provide a vapour phase corrosion inhibitor composition which overcomes the deficiencies associated with known compositions.

SUMMARY OF THE INVENTION

Accordingly, in a first aspect, the present invention provides a corrosion inhibiting composition comprising a corrosion inhibiting component comprising, by weight, 2% to 20% alkali metal nitrite or alkaline earth metal nitrite, 16% to 90% alkali metal benzoate or alkaline earth metal benzoate and 4% to 50% alkali metal molybdate or alkaline earth metal molybdate.

In another aspect the invention provides a master batch comprising the above composition and a resin carrier.

In a further aspect, the present invention provides a corrosion inhibiting plastic composition comprising a corrosion inhibiting component and a resin, wherein the corrosion inhibiting component includes 0.13% to 1.25% alkali metal nitrite or alkaline earth metal nitrite, 1% to 5.63% alkali metal benzoate or alkaline earth metal benzoate and 0.25% to 3.13% alkali metal molybdate or alkaline earth metal molybdate, by weight, of the plastic composition.

In yet another aspect, the invention provides a method of inhibiting the corrosion of metal articles comprising covering the article with a plastic film including, by weight, 0.13% to 1.25% alkali metal nitrite or alkaline earth metal nitrite, 1% to 5.63% alkali metal benzoate or alkaline earth metal benzoate and 0.25% to 3.13% alkali metal molybdate or alkaline earth metal molybdate and a suitable resin.

DESCRIPTION OF THE PREFERRED EMBODIMENTS

A vapour phase corrosion inhibitor composition in accordance with the present invention generally comprises a mixture containing 2%–20% by weight alkali metal nitrite, 16%–90% by weight alkali metal benzoate and 4%–50% by weight alkali metal molybdate.

In the presently preferred embodiment, the preferred alkali metal is sodium, although other alkali metals such as potassium, and alkaline earth metals such as calcium and magnesium are equally applicable.

The vapour phase corrosion inhibitor composition of the present application is particularly suitable for incorporation within plastic wraps in the form of coated woven products, laminated films and blown films. Preferably, the final composition of the plastic wrap comprises between 0.13%–1.25% by weight alkali metal nitrite, between 1%–5.63% by weight alkali metal benzoate and between 0.25%–3.13% by weight alkali metal molybdate. Instead of one or more of the alkali metal compounds, one or more of the corresponding alkaline earth metal compounds may be used. In a more preferred embodiment, the composition for a 1 mil (i.e. $10^{-3}$ inch), includes 0.6% sodium nitrite, 1% sodium molybdate, and 4.5% sodium benzoate.

Films of the present invention were formed with a Brabender single screw extruder fitted with a prep mixer. The temperatures for the heating zones of the extruder were as follows:

| Zone | Temperature (° C.) |
|---|---|
| 1 | 250 |
| 2 | 250 |
| 3 | 275 |

The die and melt temperatures were both 300° C. and the cold rollers used as chillers were cooled using cold tap water (10–15° C.).

Effective vapour phase corrosion inhibitor compositions and the plastic substrate containing inhibitors were determined using the following test method.

Mixtures containing 2%–20% by weight sodium nitrite, 16%–90% by weight sodium benzoate and 4%–50% by weight sodium molybdate were ground to 325 mesh size and blended with an amount of polyethylene resin. The amount of polyethylene resin was sufficient to provide a resin:inhibitor ratio of 75:25 to 70:30. The resin/inhibitor blend was extruded and pelletized to form a master batch. This master batch was then blended with low density polyethylene in a ratio of about 1:4 by weight and the blended formulation was extruded into a 1 mil thick (0.0254 mm) film having the following final composition: between 0.13%–1.25% by weight sodium nitrite, between 1%–5.63% by weight sodium benzoate and 0.25%–3.13% by weight sodium molybdate.

To determine the effectiveness of the anti-corrosion film, an experiment was devised wherein metal panels, 3"×4" in size, were bent into a U-shape. The metal panels used in the corrosion testing were handled using latex gloves to avoid getting fingerprints thereon. The bent panels were then soaked in metal hydrate and blotted dry immediately prior to wrapping with the extruded plastic film. The inside surface of the U-shaped metal panel was covered with a conventional plastic film and then a folded piece of 40 lb. kraft paper was placed into the interior of the bent panel such that the plastic film prevented the paper from coming in direct contact with the metal. The kraft paper acted as a moisture reservoir during the corrosion test.

A plastic film containing the vapour corrosion inhibitor was wrapped around the bent panel and the seams and ends of the inhibitor containing film were sealed with clear packaging tape. The wrapped panels were then placed into quart Mason jars along with 30 milliliters of distilled water. The panels were placed on top of supports within the Mason jar to prevent them from sitting in the water that condenses in the bottom of the jar during the test. The jars were sealed and placed in a forced air oven.

The samples were subjected to four cycles; each cycle consisting of 16 hours at 70° C. followed by 8 hours at room temperature (approximately 20° C.). During each test two control samples were used. In the control samples the plastic film used to wrap the bent panels did not contain any vapour corrosion inhibitor. The plastic film of the test samples contained corrosion inhibitors.

At the conclusion of the test cycles, the samples were removed from the jars and the films unwrapped from the panels. The panels were flattened using a hydraulic press. To quantify the amount of corrosion on the inner surface of the panels, the panels were scanned using a Hewlett Packard ScanJet 5p scanner and using the UTHSCSA software package, "Image Tool For Windows" (version 1.28). The amount of corrosion on each panel was determined as a percentage of the total area of the panel by the scanning method. The amount of corrosion on the control samples was used as a means of determining whether the data from a particular cycle test trial was acceptable as genuine. Specifically, a trial was considered as acceptable if the control sample had between 2.5% and 4% corrosion. In addition, the amount of the corrosion on the test samples was expressed as a percentage of the amount of corrosion on the control sample and these results are given in Table 1 under the heading "% Of Control Rust".

The results of the tests on samples containing a variety of nitrite; benzoate and molybdate compositions are provided in Table 1.

The types of plastic wraps with which the present invention can be used include low density polyethylene (LDPE) and polypropylene.

TABLE 1

Results of Tests

| | Sample - Compositions[1] | % (avg.) of Control Rust[2] |
|---|---|---|
| 1 | Molybdate, Benzoate, Nitrite | 1.8% |
| 2 | Borax (2%), Sodium Benzoate, Sodium Nitrite | 50% approx. |
| 3 | Sodium Benzoate | 44% |
| 4 | Sodium Molybdate | 70% approx. |
| 5 | Borax (2%) (i.e. disodium tetraborate) | 70% approx. |
| 6 | Nitrite | 5.4% |
| 7 | Nitrite, Benzoate | 7% |
| 8 | Molybdate, Benzoate, Nitrite (re-test) | 1.5% |
| 9 | Molybdate, Benzoate, Nitrite (0.43%) | 4.6% |
| 10 | Molybdate, Benzoate, Nitrite (0.3%) | 3.6% |
| 11 | Molybdate, Nitrite | 22% |
| 12 | Molybdate, Benzoate | 44% |
| 13 | Molybdate (1%), Nitrite, Benzoate (2.25%) | 2.1% |
| 14 | Molybdate (1%), Nitrite, Benzoate | 1.0% |
| 15 | Molybdate (0.5%), Nitrite, Benzoate | 2.5% |
| 16 | Molybdate (1%), Nitrite, Benzoate (1%) | 2.5% |
| 17 | Molybdate (1%), Nitrite, Benzoate (re-test) | 1.1% |
| 18 | Molybdate (1%), Nitrite, Benzoate (2.25%) (re-test) | 2.7% |
| 19 | Molybdate (0.25%), Nitrite, Benzoate | 8.0 |
| 20 | Molybdate (0.25%), Nitrite, Benzoate (2.25%) | 12.0 |
| 21 | Molybdate (0.50%), Nitrite, Benzoate (2.25%) | 4.7 |
| 22 | Molybdate (0.25%), Nitrite, Benzoate (1.125%) | 7.0 |
| 23 | Molybdate (0.50%), Nitrite, Benzoate (1.125%) Masterbatch (MB) (Lab Extruder) (0.5% Molybdate, Nitrite, Benzoate) | 5.2 |
| 24 | 30% MB, Eastman LDPE | 0.6 |
| 25 | 30% MB, Dow LDPE | 6.4 |
| 26 | 25% MB, Eastman LDPE | 3.7 |

TABLE 1-continued

| Results of Tests | | |
|---|---|---|
| | Sample - Compositions[1] | % (avg.) of Control Rust[2] |
| 27 | 25% MB, Dow LDPE Masterbatch (MB) (Commercial Extruder) (1.0% Molybdate, Nitrite, Benzoate) | 9.1 |
| 28 | Twin Screw, 1–2 screens, 120–150 rpm, 60–130 kg output Resin: LDPE | 6.0–10.4 |

1 - Un1ess otherwise noted, the concentrations of the respective components are as follows:
Molybdate = 2.0% Sodium Molybdate
Nitrite = 0.6% Sodium Nitrite
Benzoate = 4.5% Sodium Benzoate Further, for all samples, the processing temperature was 300° C. and the thickness of the extruded plastic film was 1 mil. 2-"% (avg.) Control of Rust" indicates the amount of corrosion (average) found on the test sample compared to the amount of corrosion found on the control sample.

Although the invention has been described with reference to certain specific embodiments, various modifications thereof will be apparent to those skilled in the art without departing from the spirit and scope of the invention as outlined in the claims appended hereto.

What is claimed is:

1. A corrosion inhibiting composition including a corrosion inhibiting component comprising, by weight, 2% to 20% alkali metal nitrite, 30% to 90% alkali metal benzoate and 4% to 50% alkali metal molybdate.

2. The composition of claim 1 wherein the alkali metal is a member selected from the group consisting of sodium and potassium.

3. The composition of claim 1 further including a resin carrier.

4. The composition of claim 3 wherein the resin carrier comprises between 25% to 30%, by weight, of the composition.

5. The composition of claim 3 wherein the resin carrier comprises low density polyethylene or polypropylene.

6. A corrosion inhibiting plastic composition comprising a corrosion inhibiting component and a resin, wherein the corrosion inhibiting component includes 0.13% to 1.25% alkali metal nitrite, 1% to 5.63% alkali metal benzoate and 0.25% to 3.13% alkali metal molybdate, by weight, of the plastic composition.

7. The plastic composition of claim 6 wherein said corrosion inhibiting component includes 0.6% sodium nitrite, 1% sodium molybdate, and 4.5% sodium benzoate, by weight, of the plastic composition.

8. The plastic composition of claim 6 wherein the alkali metal comprises a member selected from the group consisting of sodium and potassium.

9. The plastic composition of claim 6 wherein the resin comprises low density polyethylene or polypropylene.

10. The plastic composition of claim 6 wherein the composition is formed into a film.

11. A method of inhibiting the corrosion of a metal article, comprising covering said article with a plastic film including, by weight, 0.13% to 1.25% alkali metal nitrite, 1% to 5.63% alkali metal benzoate and 0.25% to 3.13% alkali metal molybdate and a suitable resin.

* * * * *